United States Patent [19]

Perry

[11] Patent Number: 4,985,934

[45] Date of Patent: Jan. 22, 1991

[54] SPORTS SLEEVE

[76] Inventor: George W. Perry, 229 W. Regent St., #4, Inglewood, Calif. 90301

[21] Appl. No.: 498,400

[22] Filed: Mar. 26, 1990

[51] Int. Cl.[5] ..... A41B 1/08

[52] U.S. Cl. ..... 2/125; 2/126; 2/59; 2/16; 128/82.1; 604/304; 604/308; 219/528

[58] Field of Search ..... 2/125, 126, 59, 16; 219/528; 128/82.1; 604/304, 308

[56] References Cited

U.S. PATENT DOCUMENTS

| | | | |
|---|---|---|---|
| 807,628 | 12/1905 | Marks | 2/59 |
| 1,117,077 | 11/1914 | Mooney | 2/59 |
| 1,285,917 | 11/1918 | Bradley | 2/59 |
| 1,424,215 | 8/1922 | Rowe | 2/59 |
| 1,796,782 | 1/1930 | Gasperini | 2/16 |
| 1,833,109 | 11/1931 | Day | 2/16 |
| 2,045,157 | 6/1936 | Mathias | 2/16 |
| 2,339,409 | 1/1942 | Joy et al. | 219/528 |
| 3,024,466 | 3/1962 | Agostini | 2/126 |
| 3,329,144 | 7/1967 | Liman | 2/59 |
| 4,229,833 | 10/1980 | Cox et al. | 2/16 |
| 4,356,570 | 11/1982 | Vernon et al. | 2/59 |
| 4,569,087 | 2/1986 | Kerwin | 2/126 |

FOREIGN PATENT DOCUMENTS

| | | | |
|---|---|---|---|
| 471249 | 2/1951 | Canada | 2/59 |

*Primary Examiner*—Werner H. Schroeder
*Assistant Examiner*—Gloria Hale
*Attorney, Agent, or Firm*—Roger A. Marrs

[57] ABSTRACT

A sleeve to be worn by a sports player, such as a baseball pitcher, is disclosed herein for covering the favored pitching arm of the player and the sleeve includes a pair of inside pockets located adjacent to the elbow and shoulder joint areas intended to be kept warm. The pockets insertably receive a therapeutic pack, either an electrical heating device or a cold pack as desired. The sleeve is attached to a partial torso covering portion to which securement straps are attached for releasably retaining the sleeve and torso covering portion on the body of the player.

1 Claim, 1 Drawing Sheet

SPORTS SLEEVE

BACKGROUND OF THE INVENTION

1. Field of the Invention

The present invention relates to the field of therapeutic sports devices and more particularly to a novel warming sleeve adapted to insertably receive the arm of a player having heating or cooling elements in pockets adjacent to the player's elbow and shoulder respectively.

2. Brief Description of the Prior Art

In the past, it has been the conventional practice for an athlete, such as a baseball pitcher, to maintain his arm in readiness when not pitching by inserting his arm into the sleeve of a jacket so that his arm is kept warm and in comfort. The remainder of the jacket generally dangles from the shoulder since the full jacket is not needed. When the player is called upon to engage in the course of play, the jacket is removed and his arm is in condition to pitch.

However, problems and difficulties have been encountered when following such a conventional practice using a standard jacket, which stem largely from the fact that the jacket does not have therapeutic elements of either a heating or cooling nature which could be placed adjacent to the joints of the player for therapeutic purposes. Also, the 3acket when half worn by the player oftentimes falls or catches on surrounding benches or equipment so that its use is awkward and inefficient.

Therefore, a long-standing need has existed to provide a novel sleeve-like garment which may be worn on one arm and which may be releasably secured to the body of the player whereby only the arm is maintained in a readiness condition. Also, such a means should provide for incorporation of heating or cooling means strategically located at the joints of the player's shoulder and elbow respectively, where the therapeutic effects will be greatest.

SUMMARY OF THE INVENTION

Accordingly, the above problems and difficulties are obviated by the present invention which provides a novel sports garment consisting of a single sleeve for insertably receiving the arm of the wearer and which includes a pair of pockets adjacent to the user's elbow and shoulder joints respectively so that appropriate heating or cold elements can be removably placed in the respective pockets. Additionally, the garment includes a body portion from which the single sleeve extends adapted to be placed against a portion of the player's torso and which further includes strap means for releasably holding the body portion of the garment in position on the player. The material may be of a quilted nature or may be of a plain cloth construction and, preferably, the free end of the sleeve may be cuffed so as to close against the wrist of the wearer's arm.

Therefore, it is among the primary objects of the present invention to provide a novel sports garment adapted to fit over the arm of a player and to be releasably secured thereto so that the joints of the player's arm are suitably maintained in a readiness condition for physical endeavor.

Another object of the present invention is to provide a novel insulated pitcher's sleeve for the purpose of minimizing arm and shoulder stiffness and tightening in the pitcher's shoulder and elbow areas.

Still another object of the present invention is to provide a novel sports garment taking the form of a sleeve that can be removably attached to the arm of the wearer so that the sleeve can be used while traveling and lounging and during a variety of sports activities.

A further object of the present invention involves a sports sleeve that may be detached from a full jacket and which includes inside pockets adjacent to specific body areas wherein the respective pockets can insertably receive electrically charged power packs which can be either warm or cold, as desired.

Still a further object of the present invention is to provide a novel sports garment having a breakaway sleeve adapted to be worn separately from a warm-up jacket which utilizes electrical power packs providing therapeutic heat or coolness to the arm and shoulder muscles of the user so as to enable the user to reduce warm-up time needed before engaging in sports activities.

A further object resides in the fact that the warm-up sleeve garment of the present invention may be included in a jacket so that the garment can be separated from the remaining part of the garment and worn as a separate part of the full jacket.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

DESCRIPTION OF THE PREFERRED EMBODIMENT

Figure 1:
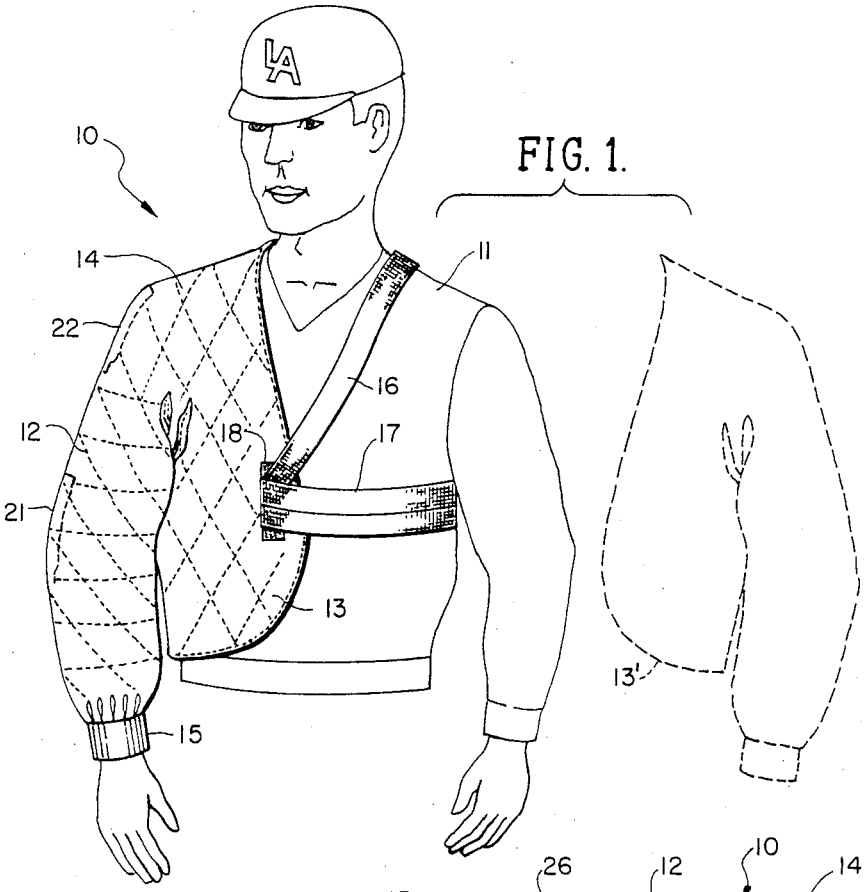
FIG. 1 is a front elevational view of a typical athlete wearing the warm-up sleeve garment of the present invention.

Referring now in detail to FIG. 1, the novel warm-up sleeve of the present invention is indicated in the general direction of arrow 10 which is illustrated as being worn by a typical player athlete, indicated by numeral 11. It can be seen that one arm of the player 11 is inserted through a sleeve 12 attached at one end to a body portion 13 that is partially wrapped about the torso of the player 11. The sleeve 12 is integrally. formed with the body portion 13 via a shoulder portion 14 so that a unitary construction exists and so that only one arm and a part of the torso is covered by the garment 10. Also, it can be seen that the free end of the sleeve 12 is provided with a cuff 15 that prevents ambient air from entering the sleeve which would destroy the therapeutic effects of the sleeve 12. The cuff may take the form of a web construction that elastically closes about the wrist of the user, or it may be of a strap and snap or hook and pile fastener to effect closure of the sleeve about the wrist or arm of the user. In one form of the invention, the warm-up sleeve may be of a plain cloth construction, or a special quilted construction may be used. In any event, the construction of the material for the garment is preferably of an insulative material so that the therapeutic effects of the heat or cold are not destroyed.

Additionally, FIG. 1 illustrates that the garment is releasably retained on the torso of the player 11 by means of a shoulder strap 16 and either a single or a pair of chest straps 17. Retention of the straps to the body portion 13 is achieved through a hook and pile fastener wherein one closure for the fastener is indicated by numeral 18 and is carried along the edge marginal region of the body portion 13 while the other portion of the closure is carried on the opposing surface of the ends of strap 16 and 17 respectively.

Figure 2:
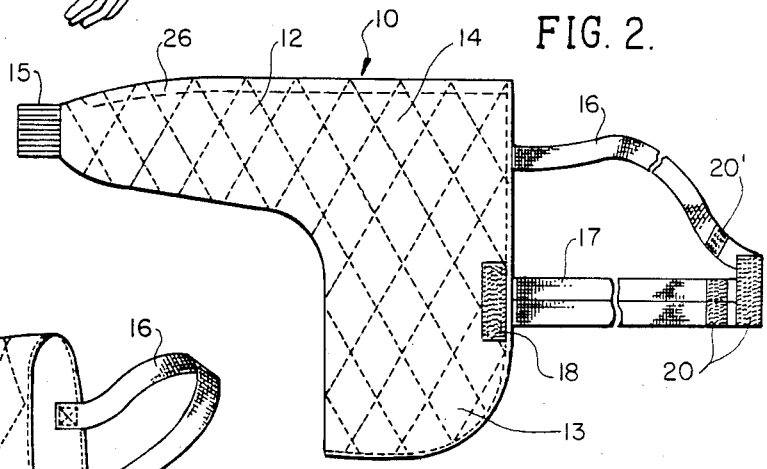
FIG. 2 is a front layout drawing of the garment used in FIG. 1 and illustrated as being of a quilted construction.

Referring now in detail to FIG. 2, it can be seen that the closure 18 may be of a hook material, while the closures 20 may be of a pile material so that a complete fastener is established. Pile material 20' is carried on the end of the strap 16 so that it may be separated from the straps 17 during placement of the garment on the body of the player or during removal thereof. FIG. 2 further illustrates that the material of the garment may be quilted so as to provide insulation necessary to keep the user's arm in a comfortable environment.

Figure 3:
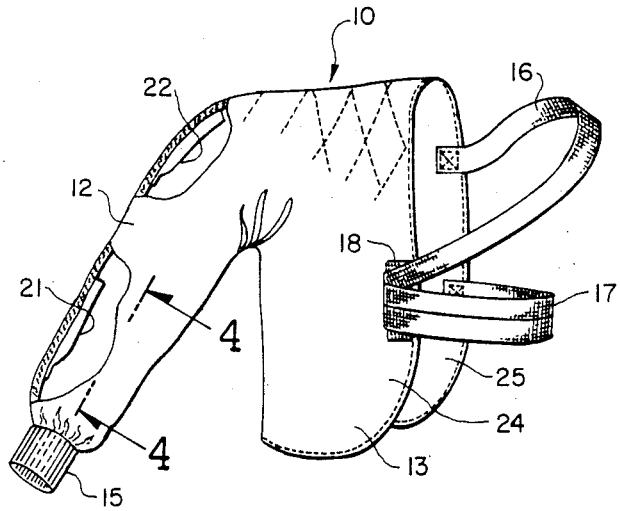
FIG. 3 is a front perspective view, partly in section, illustrating the sleeve garment and its respective elbow and shoulder pockets.
Figure 4:
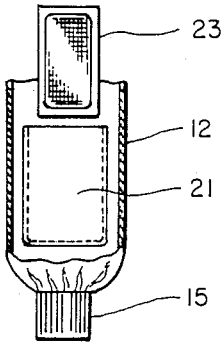
FIG. 4 is an enlarged fragmentary view, in section, taken in the direction of arrows 4—4 of FIG. 3, illustrating an electrical heating or cooling device preparatory for insertion into a pocket.

Referring now in detail to FIG. 3, it can be seen that the inside of the sleeve 12 includes a pair of pockets 21 and 22 which are critically disposed at the elbow and shoulder joint locations on the sleeve. The pockets 21 and 22 may carry a flap with a closure, such as a button, or the pockets may be open. In either event, the pockets are intended to insertably receive an electrical power pack, such as is indicated by numeral 23 in FIG. 4, which is being illustrated as being inserted into pocket 21. The power pack devices are self-contained and are under the control of the user; however, it is to be understood that these power packs do not form a part of the present invention other than in combination with the pockets in which they are inserted for keeping the player's arm joints in a desired temperature range.

FIG. 3 further illustrates that the torso or body portion of the garment, represented by numeral 13, includes a front and a back, identified by numerals 24 and 25 respectively. Therefore, not only are the arm and shoulder fully covered by the insulative garment, but the side and a part of the front and back of the torso are covered. In order to conveniently maintain the garment on one side of the player during use, the shoulder strap 16 conveniently passes over the opposite shoulder of the user from the shoulder on which the garment is placed so that its free end may be attached with the free end of the chest strap 17 to the fastener closure 18 on the front body portion 24 of the body portion 13.

In view of the foregoing, it can be seen that the novel sleeve garment of the present invention is excellent for public use as well as individuals who suffer from arthritis or sensitivity to cold. The utilization of the electrical power pack provides therapeutic heat to the arm and shoulder muscles so that this will enable the athletes to reduce warm-up time needed before sports activities. If desired, the sleeve garment of the present invention may be incorporated into a full jacket design so that two sleeves are used when desired by the player. However, when it is desired to maintain only one arm in warm-up condition, the jacket may be separated in half so that the sleeve garment 10 may be used only on one arm and retained in position by the retaining or attachment straps 16 and 17.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A sports garment comprising:

a sleeve adapted to insertably receive an arm of the user;

said sleeve having opposite ends separated by a substantially tubular midsection;

a shoulder portion integrally attached to one end of said sleeve and a cuff carried on the other end of said sleeve;

said sleeve having a pair of inner pockets located adjacent to the elbow and shoulder of the user, said packets attached to an inner surface of said sleeve;

a therapeutic pack insertably disposed in each of said sleeve inner pockets;

means detachably carried on said shoulder portion for releasably securing said sleeve to the body torso of the user;

said detachable means includes a set of straps secured at one end to said shoulder portion, closure means on their opposite ends for releasable connection with said shoulder portion;

said closure means comprises a hook and pile fastener;

a body portion integrally formed with said shoulder portion and downwardly depending therefrom to establish front and rear sections encircling the user's torso;

said straps comprising a shoulder strap and a chest strap cooperating to retain said sleeve in position on the user's arm;

said sleeve, shoulder portion and body front and rear sections are composed of an insulation material;

said front and rear sections include edge marginal regions;

one end of said straps is secured to said back section edge material region while said other ends of said straps are releasably connected to said front section edge marginal region;

said sleeve and said shoulder portion are detachably connected to a similar sleeve and shoulder portion to provide either a full jacket garment or a half jacket.

* * * * *